US007887674B2

(12) United States Patent
Gustavsson

(10) Patent No.: US 7,887,674 B2
(45) Date of Patent: Feb. 15, 2011

(54) METHODS OF FORMING AN EXTENDED NIP IN A WEB-TREATMENT APPARATUS AND CONTROLLING LOAD IN THE NIP, EMPLOYING AN ELASTIC SUPPORT BODY AS ONE OF THE NIP-FORMING ELEMENTS

(75) Inventor: Tord Gustav Gustavsson, Forshaga (SE)

(73) Assignee: Metso Paper Karlstad AB, Karlstad (SE)

( * ) Notice: Subject to any disclaimer, the term of this patent is extended or adjusted under 35 U.S.C. 154(b) by 0 days.

(21) Appl. No.: 12/556,283

(22) Filed: Sep. 9, 2009

(65) Prior Publication Data

US 2009/0321033 A1 Dec. 31, 2009

Related U.S. Application Data

(62) Division of application No. 10/575,982, filed on Dec. 26, 2006, now Pat. No. 7,686,924.

(51) Int. Cl.
*D21F 11/00* (2006.01)

(52) U.S. Cl. ..... 162/202; 162/358.3

(58) Field of Classification Search ..... 162/202, 162/358.3, 272, 361; 100/153, 156
See application file for complete search history.

(56) References Cited

U.S. PATENT DOCUMENTS

| | | | |
|---|---|---|---|
| 3,839,147 | A | 10/1974 | Daane |
| 4,468,287 | A | 8/1984 | Dahl |
| 4,568,423 | A | 2/1986 | Laapotti |
| 4,576,682 | A | 3/1986 | Laapotti |
| 4,851,119 | A | 7/1989 | Berglöff et al. |
| 5,951,824 | A | 9/1999 | Deshpande |
| 5,980,693 | A | 11/1999 | Liang et al. |
| 6,334,933 | B1 | 1/2002 | Koski |

(Continued)

FOREIGN PATENT DOCUMENTS

| | | |
|---|---|---|
| DE | 30 30 233 | 2/1982 |

(Continued)

OTHER PUBLICATIONS

DE 3030233, Feb. 1982, translation.*

(Continued)

*Primary Examiner*—Mark Halpern
(74) *Attorney, Agent, or Firm*—Alston & Bird LLP

(57) ABSTRACT

A support body for an apparatus having an extended nip that is defined by a contact surface of the support body and an opposed surface, the support body having two side surfaces facing from each other and connecting to the contact surface, and a bottom surface facing from the contact surface, the support body being arranged to be moved towards the opposite surface by means of a loading system in order to load the nip via the contact surface. The support body is elastically deformable and has its contact surface adaptable to the opposite surface in interaction therewith. A method of forming an extended nip in an apparatus includes loading the support body by means of a loading system, and a method of controlling the load in the extended nip includes designing the support body with at least two layers with different elasticity providing a corresponding load profile.

2 Claims, 7 Drawing Sheets

U.S. PATENT DOCUMENTS 6,387,216 B1 5/2002 Koski

FOREIGN PATENT DOCUMENTS

| | | | |
|---|---|---|---|
| DE | 30 30 233 A1 | | 2/1982 |
| DE | 3030233 | * | 2/1982 |
| DE | 44 05 587 | | 9/1994 |
| EP | 0 575 353 | | 12/1993 |
| EP | 1 319 744 | | 6/2003 |
| WO | WO 02/44467 | | 6/2002 |

OTHER PUBLICATIONS

International Search Report for PCT/SE2004/001486; Filed Oct. 15, 2004; Date of Completion Jan. 20, 2005; Date of Mailing Feb. 9, 2005.

* cited by examiner

METHODS OF FORMING AN EXTENDED NIP IN A WEB-TREATMENT APPARATUS AND CONTROLLING LOAD IN THE NIP, EMPLOYING AN ELASTIC SUPPORT BODY AS ONE OF THE NIP-FORMING ELEMENTS

CROSS-REFERENCE TO RELATED APPLICATION

This application is a divisional of U.S. patent application Ser. No. 10/575,982 filed on Dec. 26, 2006, now U.S. Pat. No. 7,686,924, the entire disclosure of which is hereby incorporated herein by reference.

BACKGROUND OF THE INVENTION

The present invention relates to a support body for an apparatus having an extended nip defined by a contact surface of the support body and an opposed surface, wherein the support body has two side surfaces facing from each other and connecting to the contact surface, and a bottom surface facing from the contact surface, and is arranged to be moved in the direction towards the opposite surface by means of a loading system in order to load the nip via the contact surface.

The invention also relates to a holding device for such a support body.

The invention further relates to an apparatus/press for the treatment of a fiber web that is manufactured in a paper or board machine, comprising a first structural element and a second structural element which is movably arranged and having an opposite surface for interaction with the first structural element while forming an extended nip, the first structural element comprising a movable clothing and a support body/press body having a contact surface/press surface that defines the nip together with the opposite surface, wherein the support body/press body has two side surfaces facing from each other and connecting to the contact surface/press surface, and a bottom surface facing from the contact surface/press surface, and is arranged to be moved in the direction towards the opposite surface by means of a loading system in order to load the nip via the contact surface/press surface.

The invention also relates to a method of forming an extended nip in an apparatus that comprises the support body.

The invention also relates to a method of controlling the load in an extended nip in an apparatus that comprises the support body.

The previously known presses with an extended press nip have a so-called press shoe, which consists of a metallic material such as aluminium or steel, and are designed with a press surface, usually a concave press surface, whose profile is very accurately adapted to the opposed counter-pressure surface. Such a press shoe is very complicated to manufacture and therefore involves a very high cost. Because it consists of metal, it is relatively rigid and inflexible. The press roll acting as a counter roll of such a shoe press can have a relatively thick cylinder wall that withstands the forces from the press shoe. In accordance with another embodiment of the counter roll, it has a relatively thin cylinder wall and is provided internally with a counter pressure system for adjustable crowning of the thin, and thus deformable, cylinder wall or shell in dependence of the forces the press shoe has to apply on the counter roll in order to obtain the desired load. Also the press shoe can be crowned in accordance with the crowning of the counter roll, and it will then be usable only in combination with this counter roll. Alternatively, the metallic press shoe can be tilted by means of hydraulic cylinders.

A Yankee cylinder has a cylinder wall or shell that is relatively thin and that easily is deformed by impression of the press shoe when the Yankee cylinder is used as a counter roll. The deformation of the shell varies in an axial direction from the central region in a direction towards the end walls, where the impression is substantially smaller than within the central region. Therefore, the press shoe will act with a higher pressure at and in the vicinity of the end walls, resulting in an increased wear at the edges of the press felt and an irregular load profile along the press shoe, which in its turn results in variable paper properties crosswise to the machine direction. It has been proposed to crown the shell of the Yankee cylinder by means of an internal counter-pressure system, or to arrange two or more rows of hydraulic cylinders on the underside of the press shoe for influencing the press shoe to conform to the deformed surface, in both cases in order to achieve a more uniform load profile. Both proposals, however, are complicated and expensive to carry out.

The following documents are examples of presses having extended press nips.

DE 44 05 587 and WO 02/44467 describe a press having a hydrostatic bearing, including a press shoe 3 or double press shoes 3a, 3b of the same design. A press belt 6 rotates on top of a lubricating fluid bed of the press shoe 3 with a very small friction. The press shoe, which is made of metal, has a pressure chamber 10 containing a hydraulic fluid, preferably water. A rectangular pressure-equalizing membrane 20, consisting of a suitable solid material, preferably stainless steel, is fixed on the press nip side of the press shoe. The pressure-equalizing membrane 20 has an outer edge 26, an inner edge 22, and an opening 27 that is defined by the inner edge 22. The pressure-equalizing membrane 20, thus looking like a frame, is flexible so that an edge zone 21, standing in direct contact with the hydraulic fluid, can deflect when pressure differences occur between its two sides. These pressure differences arise when hydraulic fluid happens to leak out through the press nip as a result of irregularities in the paper web and/or in the envelope surface of the counter roll. Thus, the flexible pressure-equalizing membrane 20 creates a self-adjusting nip 2 having no or only a minimum of fluid leakage. Thus, through the opening 27 in the pressure-equalizing membrane 20, the pressure fluid in the pressure chamber 10 stands in direct contact with the movable belt. The complementary addition that has been done in the WO-publication in comparison to the DE-publication is that the flexible membrane has been provided with "pinholes 25" within its free edge zone 21 in order to conduct hydraulic fluid from the pressure chamber 10 to the belt 6 for the purpose of lubricating the belt.

U.S. Pat. No. 5,980,693 describes presses having a tube-shaped or inflatable loading element, but with a metal shoe between the loading element and the inside of the belt. Furthermore, this part of the shoe is constructed in order to provide a slow reduction of the pressure in the nip outlet. Normally, an abrupt pressure drop is desired.

U.S. Pat. No. 3,839,147 describes a shoe press having two opposed shoes. Each shoe has a metal bottom and sills, sealing against the inside of the belt. The side of the shoe facing the belt is a perforated diaphragm, which causes the pressure of the hydraulic fluid in a pressure chamber to load the inside of the belt directly. The shoe is of a rather complicated construction with various apertures and reinforcements.

U.S. Pat. No. 5,951,824 describes an ordinary shoe having ordinary hydraulic loading elements. The shoe is coated with a soft and durable layer of polymer or rubber in order to reduce the risk of damages to the belt and shoe from paper wads passing through the press nip.

EP 0 575 353 describes a press having a shoe, which is loaded with bellows arranged inside a metal cover of the shoe, wherein a belt slides around the metal cover.

U.S. Pat. No. 6,334,933 describes a press having a counterpart of metal, which is provided with a plurality of pressure pockets sealed by a metal plate and hoses, which also can contribute to loading the opposite portions of the press nip.

U.S. Pat. No. 6,387,216 describes a press having an open fluid chamber, over which a belt is running and which is loading the press nip. The chamber is sealed by means of setting the belt under pressure, so that it is tightened over the edges of the chamber.

EP 1 319 744 describes a method for measuring and regulating the nip pressure in a shoe press, crosswise to and along the web, by means of measuring and continuously adapting the hydraulic static pressure in reference points above measurement holes in the press nip.

DE 30 30 233 describes an elastic slide shoe that is attached to a stand of metal. The slide shoe includes a solid body or a hollow body in the form of a hose that can be filled with a pressure medium. The hose is surrounded by an elastic belt that is attached to the metal stand. The hollow body may be divided into chambers that can be pressurized to different pressures. However, a change of pressure in the chamber or chambers does not result in a change of the loading in the nip because of the fact that the hollow body is permitted to expand laterally during every such increase of pressure.

U.S. Pat. No. 4,576,682 describes a press with a shoe consisting of two shoe parts each of which being able to load the nip in a hydrodynamic manner.

U.S. Pat. No. 4,568,423 describes a press with a shoe having a shoe part in the form of a hydrostatic chamber, and two further shoe parts having hydrodynamic press function, the further shoe parts also sealing the hydrostatic shoe part.

BRIEF SUMMARY OF THE INVENTION

It is an object of the invention to provide an elastic support body that, in relation to known support bodies, can be manufactured in a simpler way, without any special machining and without any major consideration to the shape of the opposed surface that it is to work against, and that can provide a loading profile in dependence of the pressure that can be applied with the loading system in the same way or even in a better way than what is possible with a conventional support body of metal with one or more rows of pressure pockets that are closed by a running belt.

The support body according to the invention is characterized in that the support body is elastically deformable and has its contact surface adaptable to the opposed surface in interaction therewith.

The holding device according to the invention is characterized in that the support body is elastically deformable and has its contact surface adaptable to the opposed surface in interaction therewith.

The apparatus/press according to the invention is characterized in that the support body/press body is elastically deformable and has its contact surface/press surface adaptable to the opposed surface in interaction therewith.

The method of forming an extended nip according to the invention is characterized by the steps of:

mounting the support body in the holding device;

loading the support body by means of the loading system; and displacing the contact surface of the support body in the direction towards the opposite surface under the influence of the loading in order to elastically deform the contact surface and adaptation to the opposite surface.

The method of controlling the load in an extended nip according to the invention is characterized by the steps of:

designing the support body of at least two layers of elastic material having different elasticity;

mounting the support body in the holding device;

loading the support body by means of the loading system; and displacing the contact surface of the support body in the direction towards the opposite surface under the influence of the loading in order to elastically deform the contact surface and adaptation to the opposite surface in order to obtain an extended nip having a load profile in dependence of different elasticities of the layers.

The expression "nip" is to be interpreted in its broadest meaning in order to involve such a nip that is defined by a wire and support body.

BRIEF DESCRIPTION OF THE DRAWINGS

In the following, the invention will be described further with reference to the drawings.

DETAILED DESCRIPTION OF THE DRAWINGS

The invention will be described in connection with a press for dewatering a fiber web. Naturally, in addition to the press section, the invention can be applied to any suitable apparatus for the treatment of a fiber web, e.g., an apparatus in a drying or forming section of a paper or board machine, and in a calender for surface treatment of the fiber web.

Figure 1:
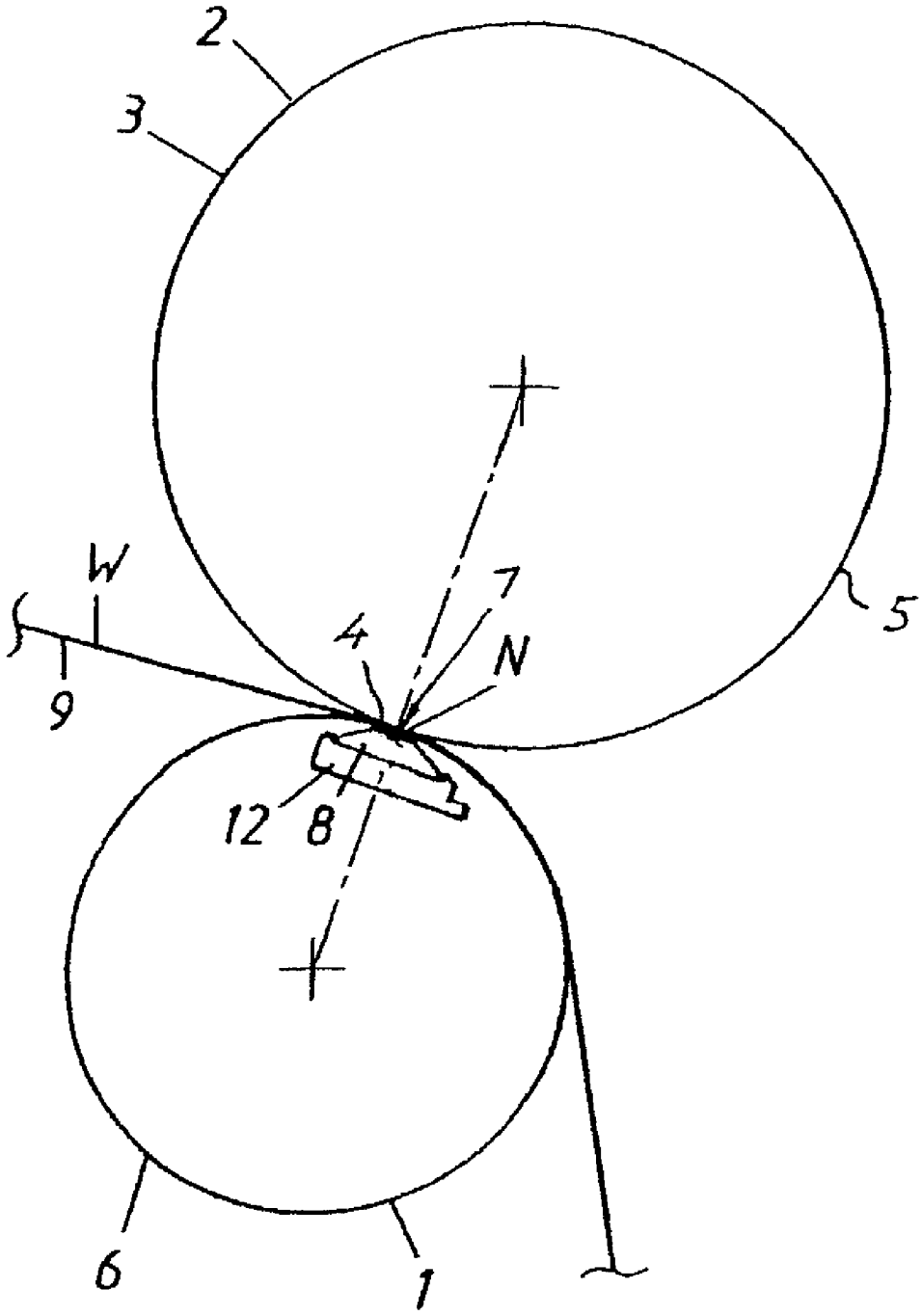
FIG. 1 shows a press according to the invention with a press body and a holding device according to a first embodiment.

FIG. 1 shows schematically portions of a press, which is arranged in the press section of a paper or board machine in order to press water out of a formed, wet fiber web. Advantageously, the invention can be used in a paper machine of the tissue machine type. The press includes a first press element 1 and a second press element 2. The press elements 1, 2 are interacting with each other in order to form an extended press nip N.

The second press element 2 includes a counter-pressure member being active in the press nip N and having a movable, endless surface 3, which forms an opposed surface or counter-pressure surface 4, which can be curved or linear, within the press nip N. In the shown embodiment of the press, the second press element 2 consists of a counter roll in the form of a press roll. The counter roll also can be a drying cylinder in a conventional drying section, or a drying cylinder in a tissue machine designated Yankee cylinder. In this case, the counter-pressure member includes the cylindrical wall 5 of the counter roll 2 the envelope surface of which forms the movable, endless surface 3, which within the extended press nip N forms the counter-pressure surface 4, which can be at room temperature or a temperature raised by means of heating. Provided that the cylinder wall 5 is thick and stable enough, it constitutes the counter-pressure member as such. In the case when the cylinder wall 5 is thin and deformable, the counter-pressure member further includes an internal supporting system (not shown), which provides the necessary counter-force.

The first press element 1 includes a movable, endless belt 6 of a flexible material, a support body 7 in the form of a press body, a holding device 8 for mounting the press body 7, a support for mounting the holding device 8, and a loading system for activating the press body 7. The movable belt 6 describes a closed loop inside of which the press body 7 and the support are located. Before the press nip N, the movable belt 6 is arranged for meeting a press felt 9 carrying a wet fiber web W that is to be dewatered when it passes through the extended press nip N. The loading system is arranged for being activated in order to influence the press body 7 during the operation of the press for obtaining pressure forces that the press body 7 exerts against the counter roll 2 via the belt 6, the press felt 9 and the web W. The press body 7 is arranged for deciding the length of the extended press nip N, as seen in the machine direction. The press body 7 has a free sliding surface 10 (see FIG. 3) with which the rotating belt 6 is in sliding contact during the operation of the press, whereby the sliding surface 10 entirely or partially forms a contact surface or press surface 13, which together with the counter-pressure surface 4 defines the press nip N. In addition to the sliding surface 10/press surface 13, the press body 7 having two vertical side surfaces 69, 70 (see FIG. 6) facing from each other, being parallel with each other and connecting to the sliding surface 10/press surface 13, and a bottom surface 71 facing from the sliding surface 10/press surface 13 and connecting to the side surfaces 69, 70 under right angle. A spraying device (not shown) is mounted upstream the press body 7 for supplying lubricant on the inside of the belt 6 in order to form a film that reduces the friction between the rotating belt 6 and the press body 7.

In the shown embodiment of the press, the first press element 1 consists of a press roll, the shell of which forms the movable belt 6 that describes a substantially circular loop. In an alternative embodiment of the press (not shown), the flexible, movable belt is arranged for running in a non-circular loop, e.g., in a substantially oval loop or in a substantially triangular loop, around the press body and one or several guide rolls. In the embodiment shown, the press roll 1 has two circular, rotatably mounted end walls (not shown), whereby the shell 6 is rigidly mounted to the peripheries of the end walls in order to rotate together with them. The shell 6 and the end walls define a closed space in which the support is located, the support including a stationary supporting beam 12 extending axially between the end walls without touching them. Also the press body 7 and its holding device 8 are extending axially between the end walls without touching them. Alternatively, the second press element 2 can be of the same or substantially the same design as the above-described first press element 1, whereby the press nip thus is formed by two press bodies according to the invention.

According to the invention the press body 7 is elastically deformable and has its press surface 13 adaptable to the counter-pressure surface 4 in interaction with this. This adaptation takes place under the influence of a load being created by the loading system, on the press body 7 in direction towards the counter-pressure surface 4 in order to load the entire press nip N correspondingly. The definition that the press body is elastically deformable does not necessarily imply that the entire press body consists of an elastic material, but should in the context of the invention be seen in a broader sense, viz. that the press body has at least one functional portion consisting of an elastic material and fulfilling the definition. For practical and production-engineering reasons, and according to the most preferred embodiments the press body is in its entirety made in one piece of an elastic material or several pieces of elastic material, where the pieces have different elasticity. The press body forms the entire length of the press nip seen in the machine direction.

Figure 2:
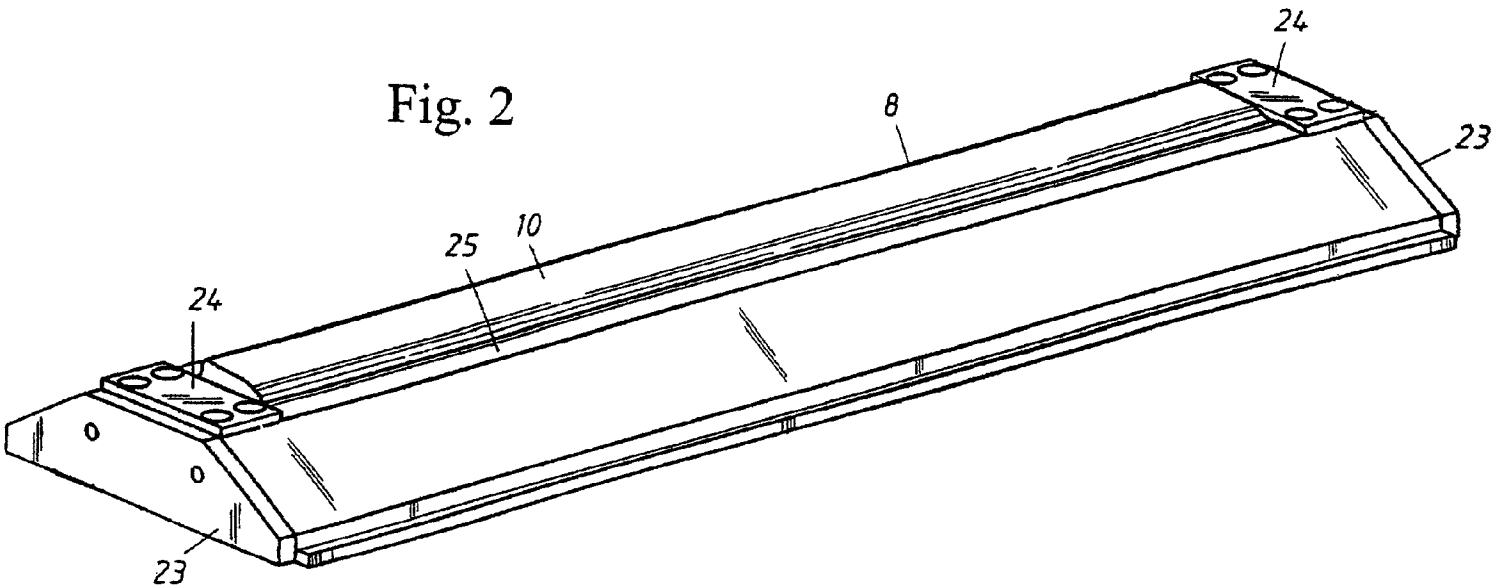
FIG. 2 is a perspective view of the press body and the holding device according to FIG. 1.
Figure 3:
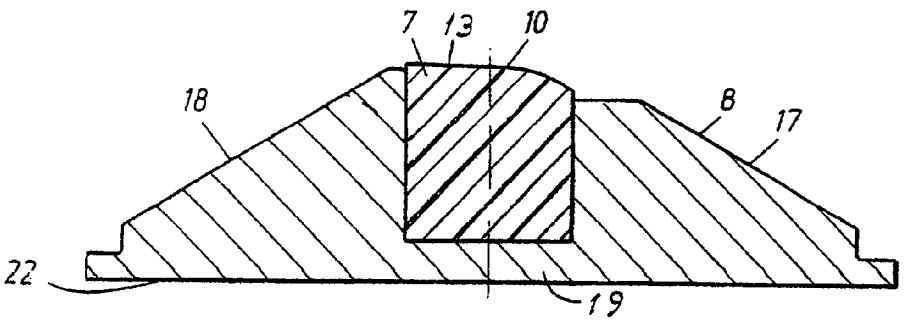
FIG. 3 is a cross-section of the press body and the holding device according to FIG. 2.
Figure 4:
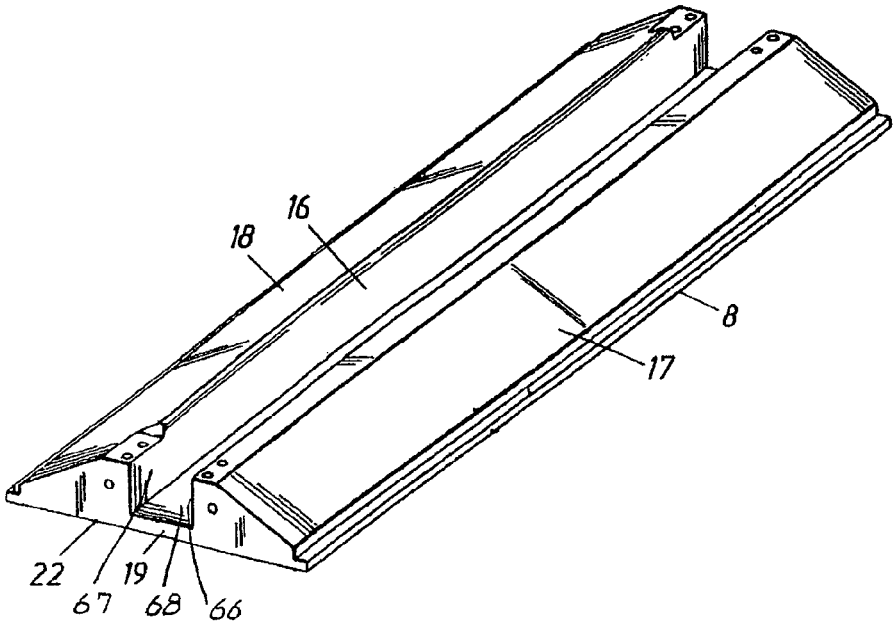
FIG. 4 is a perspective view of the holding device according to FIG. 2, without press body.
Figure 5:
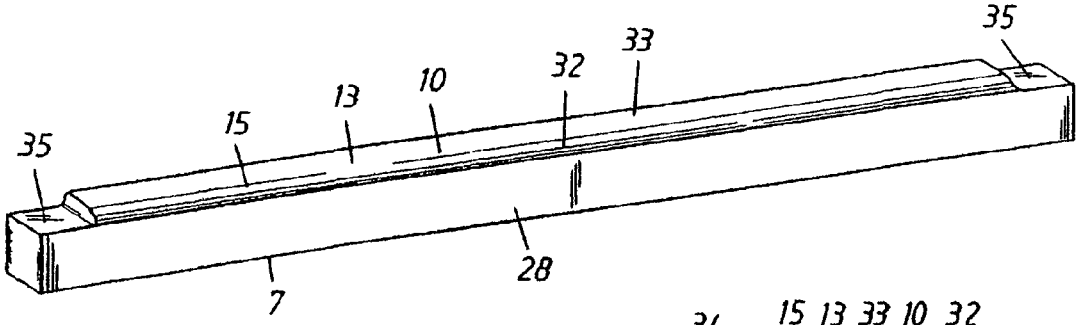
FIG. 5 is a perspective view of the press body itself according to FIG. 2.
Figure 6:
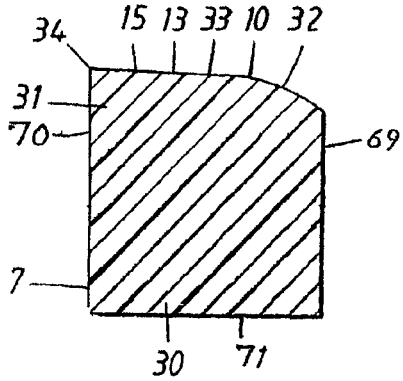
FIG. 6 is a cross-section of the press body according to FIG. 5.

The press body 7 and its holding device 8, that is a part of the press according to FIG. 1, are shown in detail in FIGS. 2 and 3, whereas these two structural elements are shown separately in detail in FIGS. 5 and 6 and FIG. 4, respectively. As is evident from FIG. 4, the holding device 8 includes an elongated, beam-formed holder 22, which is form-stable and provided with an axially through-going channel 16 having a U-shaped or rectangular cross-section and being defined by two side support portions 17, 18 and a bottom support portion 19 connecting them, the three portions 17, 18, 19 form two inner side surfaces 66, 67 (see FIG. 6) facing each other and being parallel with each other, and an inner bottom surface 68 forming a right angle to the side surfaces 66, 67. The three surfaces 66, 67, 68 thus define the channel 16. Furthermore, it is evident from FIG. 2 that the holding device includes two end plates 23 for detachable mounting to the opposed, parallel end surfaces of the holder 22 as well as two clamping plates 24 for detachable mounting on top of the side support portions 17, 18. As is evident from FIGS. 2 and 3, the side support portion 17, being intended to be located at the inlet of the press nip N, is provided with a recess 25 extending between the clamping plates 24 in order to expose the press body 7. FIGS. 5 and 6 show the press body 7, which is intended to be mounted in the channel 16 of the holder 22 and which has a cross-section being adapted to the cross-section of the channel 16, so that no play arises between opposite lateral surfaces 67, 69; 68, 70 and so that the press body 7 with its bottom surface 71 comes to rest against the bottom surface 68 of the channel 16. The press body 7 has a top portion 31 that includes the sliding surface 10 and being arranged to be located outside the holding device 8, as is shown in the drawings, at least when the press body entirely fills up the channel 16. In order to avoid undesired deformation laterally the top portion 31 has a limited dimension outside the holding device, however this dimension is sufficient to prevent the holding device 8 coming in contact with the belt 6 when the press nip is loaded. The free sliding surface 10, which will be facing the counter roll 2, and with which the rotating belt 6 will be in sliding contact during operation, is, as seen in a cross-sectional view, designed with a predetermined arch-shape in order to form an initial, curved surface portion 32 having a predetermined radius, and a surface portion 33 being tangential to the curved surface portion 32 and extending up to the sharp corner 34 that the sliding surface 10 forms with the side surface 70 being fixed in the machine direction. The purpose of the curved surface portion 32 is to create a wedge between the rotating belt 6 and the curved surface portion 32 in order to make it possible to get lubricant to follow the belt 6 on its inside while forming a film between the belt 6 and the sliding surface 10. The corner 34 forms the outlet of the press nip N, while the inlet of the press nip N at the curved surface portion 32 becomes floating depending on the pressure provided by the loading system. The press body 7 has recessed end portions 35 that enable a simple, detachable mounting in the holder 22 by means of the clamping plates 24, as is evident from FIG. 2.

As mentioned in the foregoing, the press body 7 is elastically deformable in order to bring the press surface 13 to form in compliance with the counter-pressure surface 4 of the counter roll. As is evident from FIG. 6, the press body 7 is made in one piece of an elastic material. The elastic deformation occurs both in the machine direction MD and crosswise to the machine direction CD in dependence of the shape of the counter-pressure surface 4, i.e., the press surface 13 conforms to and adopts the outline of the counter-pressure surface 4, and the portion of the sliding surface 10 defining the press nip, i.e., the press surface 13, which in this case corresponds to the press zone 15, changes its form in accordance with the opposed counter-pressure surface 4 of the counter roll 2.

Figure 7:
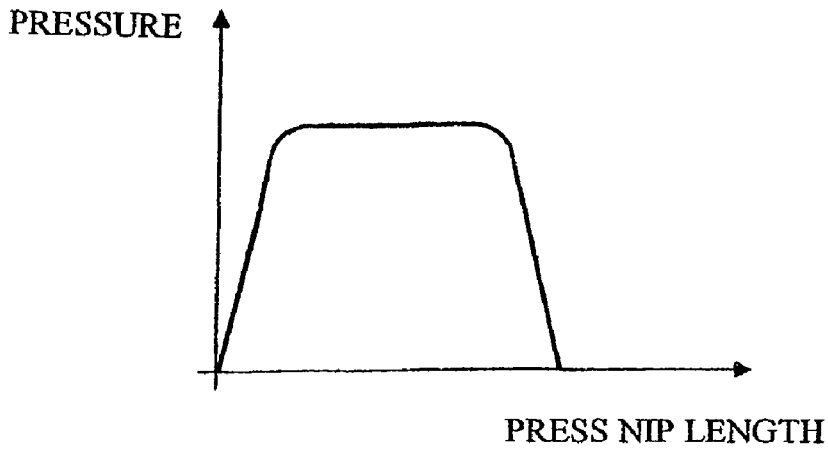
FIG. 7 is a graph depicting the pressure curve that is obtained with the press body according to the first embodiment.

The press body 7, being used in the embodiments according to FIGS. 1-6, and being designed in one piece, achieves a load profile or pressure curve as illustrated in FIG. 7.

FIGS. 8-14 illustrates schematically different embodiments of the combination of press body 7, holding device 8 and loading system.

Figure 8:
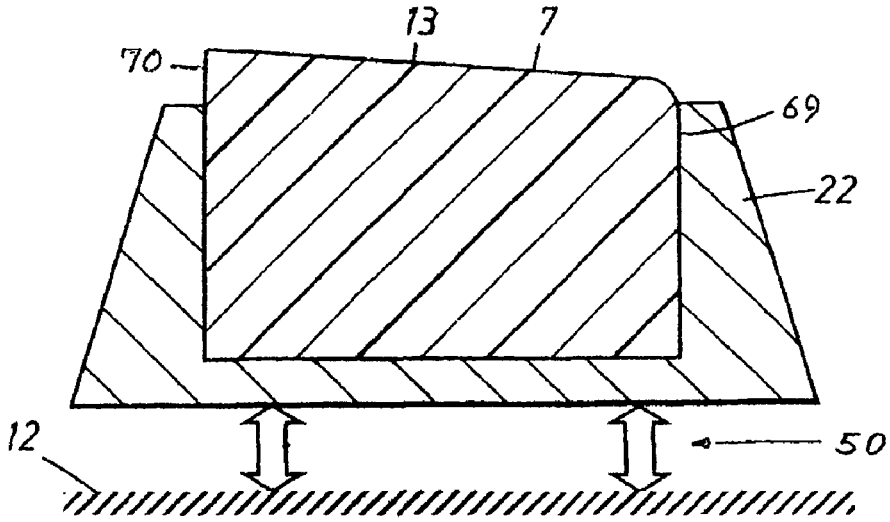
FIGS. 8-10 show schematically a press body and a holding device according to the invention and different types of loading systems.

In the embodiment according to FIG. 8 the loading system comprises a power transmitting device 50 in the form of hydraulic cylinders, pneumatic cylinders, jacks or the like, mounted in two rows between the holder 22 and the supporting beam 12. The press surface 13 is inclined in relation to the side surfaces 69, 70. By the influence of the power transmitting device 50 the press body 7 is pressed against the counter-pressure surface 4, which is deformed elastically to conform to and adopt the contour of the counter-pressure surface 4.

Figure 9:
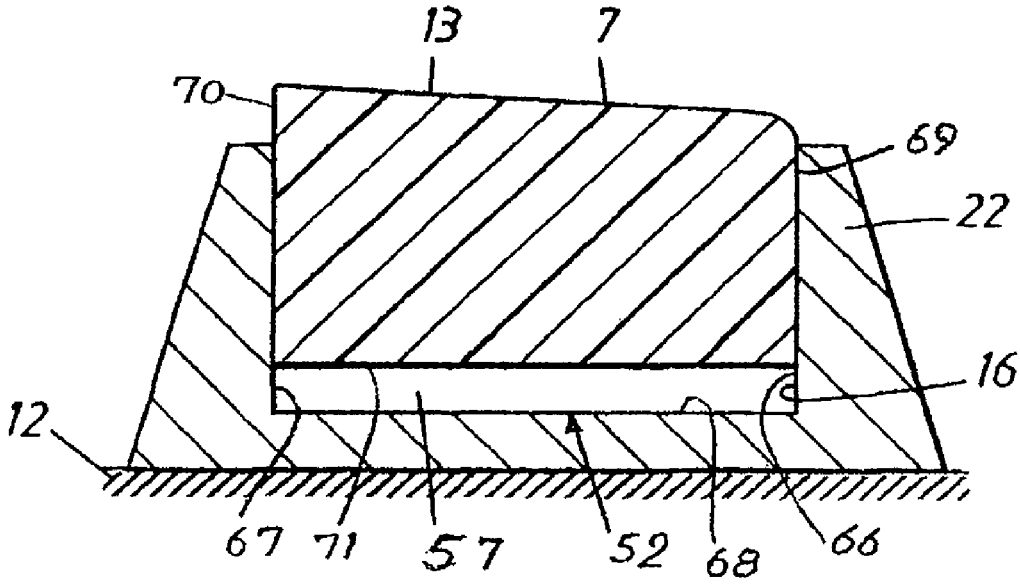
Figure 11:
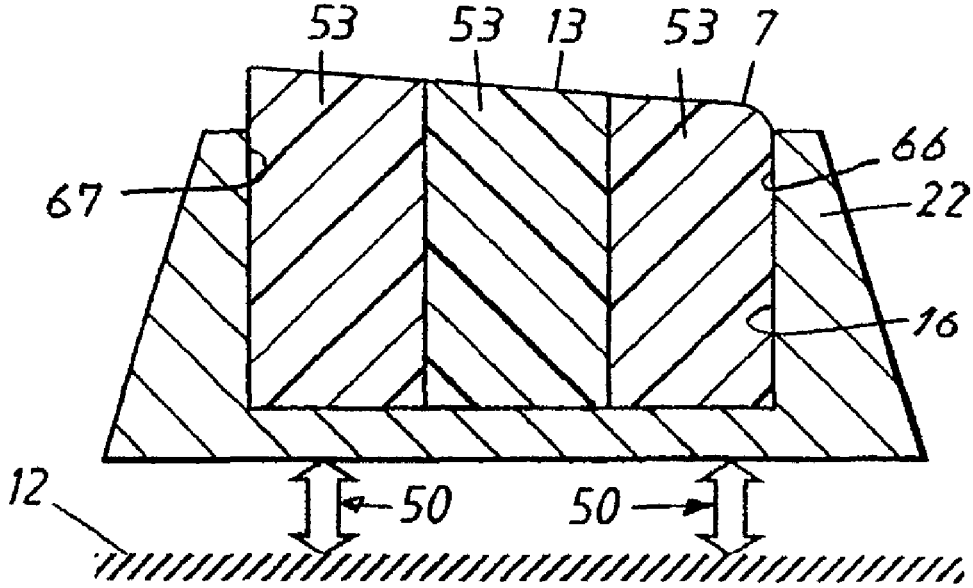
FIG. 11 shows schematically a press body consisting of three vertical layers of elastic material with different elasticity.

In the embodiment according to FIG. 9 the loading system comprises a power transmitting device 50 that includes a pressure chamber 57 being in communication with a pressure medium source (hydraulic or pneumatic) through a conduit and a suitable control member (not shown) for regulating the pressure in the pressure chamber 57. In this case the holder is rigidly mounted to the supporting beam 12. The pressure chamber 57 is defined by an inner portion of the channel 16 in which the press body 7 is received in a sealing manner. The press body 7 thus functions as a piston to be slidably moved in relation to the counter roll 2 and elastically deformed against this in dependence of the pressure prevailing in the pressure chamber 57. Since the press body 7 consists of elastic material it will itself form a seal against the side walls 66, 67 of the holder 22. Alternatively, if desired, special sealings (not shown) can be mounted in the side walls 66, 67 in order to seal against the opposite side surfaces 69, 70 of the press body 7.

Figure 10:
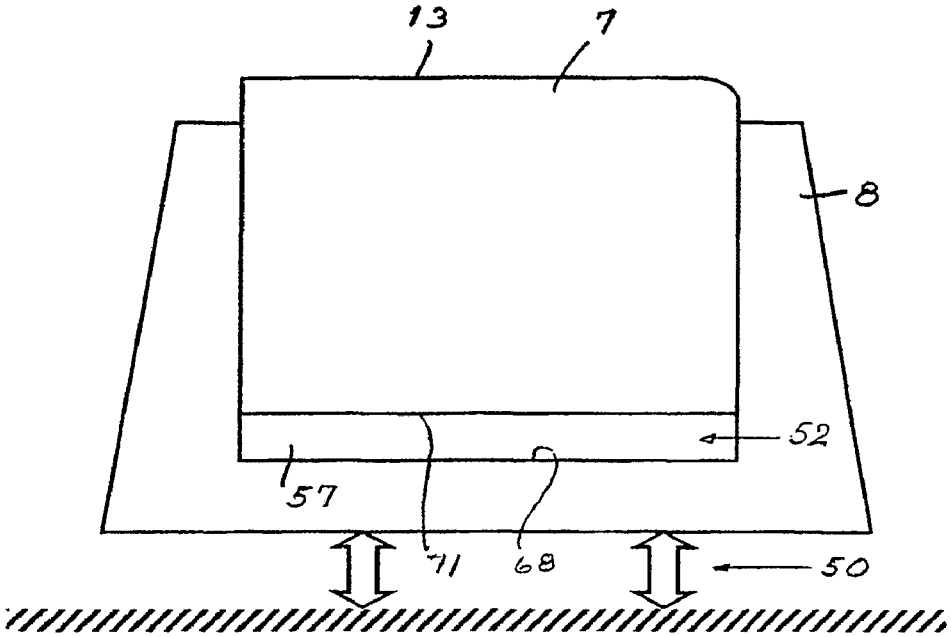

In the embodiment according to FIG. 10 the loading system comprises a combination of the embodiments according to FIGS. 8 and 9, i.e., a first power transmitting device 50 of the type defined and a second power transmitting device 52 of the type defined. In such an arrangement the press body 7 can be mounted in a first starting position having its press surface 13 at a touch-free distance from the opposite counter-pressure surface 4, wherein the holding device 8 and the press body 7 are arranged to be moved together by means of the first power transmitting device 50 in the direction towards the counter-pressure surface 4 to a second starting position having the press surface 13 of the press body 7 in contact with or nearly in contact with the counter-pressure surface 4 (via the belt 6). The pressure in the pressure chamber 57 is then raised so that the press body 7 slides out from the holding device a small distance and is pressed against the counter-pressure surface 4 while becoming elastically deformed in order to form a nip-forming operation position with a desired load profile, wherein the first power transmitting device 50 now at first hand functions as a counterstay.

Figure 12:
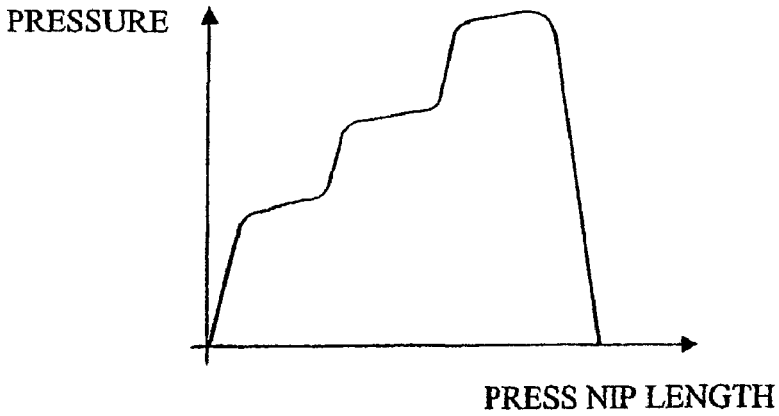
FIG. 12 is a graph depicting the pressure curve that can be obtained with the press body according to FIG. 11.

In the embodiments described above the press body 7 is made in one piece of elastic material. In the embodiment according to FIG. 11 the press body 7 is made of three longitudinal, vertical pieces 53 of elastic material with different coefficients of elasticity, the pieces 53 forming layers and being parallel with the vertical side surfaces 66, 67 of the channel 16. Such a multi-layered press body 7 produces a stepped load profile or press curve as illustrated in FIG. 12.

Figure 13:
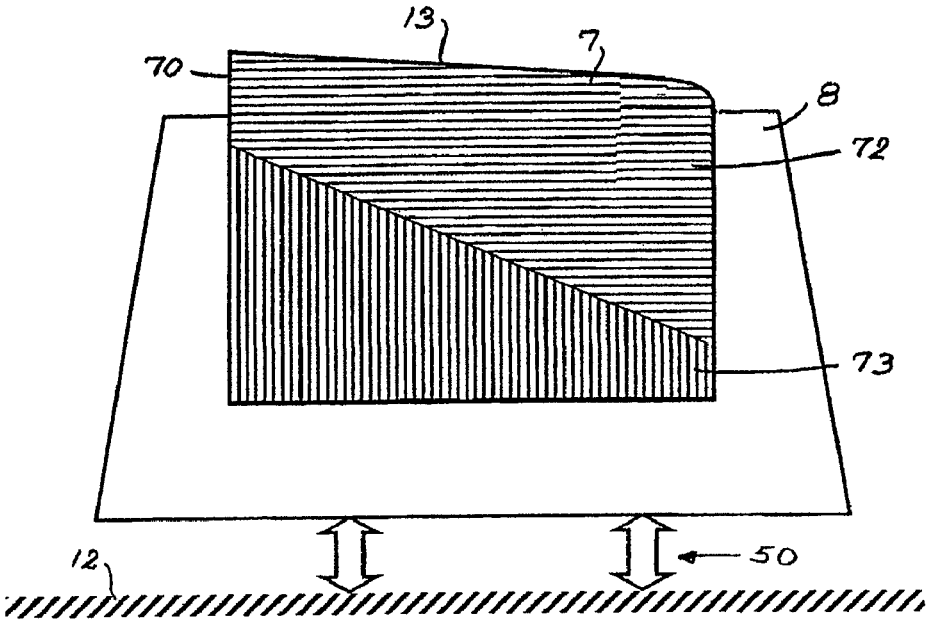
FIGS. 13 and 14 show schematically press bodies consisting of two and three, respectively, inclined layers of elastic material with different elasticity.
Figure 14:
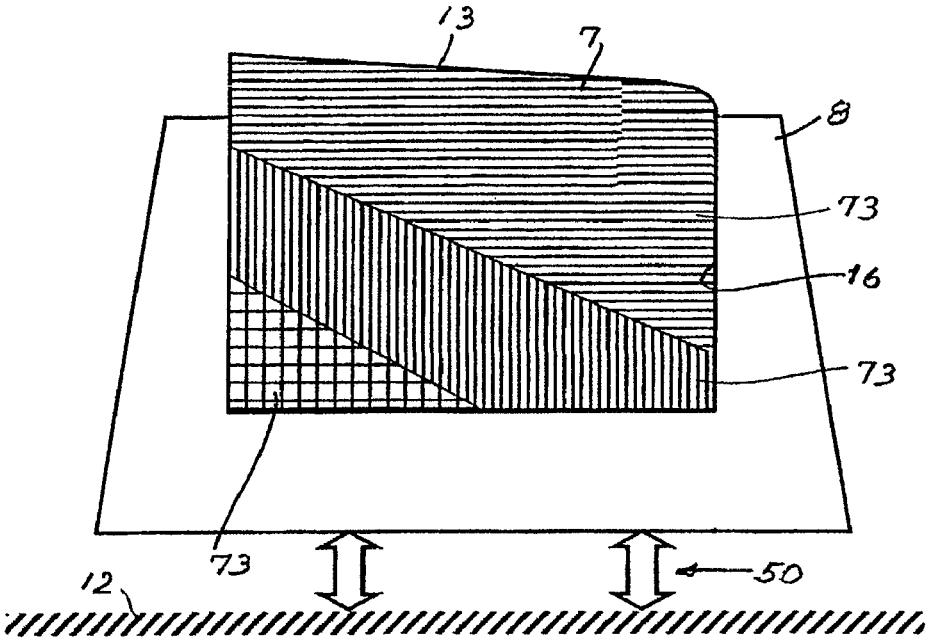

In FIGS. 13 and 14 further examples of multi-layered press bodies 7 are illustrated, wherein the surfaces of the layers 72 and 73, respectively, contacting each other are inclined, i.e., the surfaces define an acute angle with the downstream, vertical side surface 70 of the press body 7. The layers have different elasticities or hardness values, as is indicated by the line and square designed surfaces, for attaining load profiles with different progresses in dependence of the compression or deformation of the different layers.

With the exception for the embodiment according to FIG. 10, the press bodies 7 are designed with a press surface 13 that is inclined so that it defines an acute angle just under 45°, i.e., between 42° and 44, 9°, with the downstream side surface 71 of the press body 7 thereby initiating the load at the outlet portion of the nip when the press body is moved towards the counter-pressure surface 4. In the embodiment according to FIG. 10 on the other hand, the press surface 13 is plane so that it defines a right angle to the upstream side surface 70 of the press body 7.

In an alternative embodiment (not shown) of the press body, at least one of the elastic layers is made of at least three sections, that are distributed crosswise to the machine direction, of elastic material of at least two different elacticities in order to obtain load profiles describing different curves depending on the composition of the sections in each cross-section of the press body.

In the above-described embodiments, the press body is homogeneous, i.e., it lacks enclosed cavities. However, if desired, the press body can be made with one or several enclosed cavities or enclosed cells so that each such cavity or cell is without any communication with the surroundings. One or several such enclosed cavities or enclosed cells will increase the ductility of the press body in connection with its sliding surface and in relation to the counter roll.

The press body according to the invention has a number of essential advantages of which the following can be mentioned.

- It is self-conforming to the outline of the counter-pressure surface.
- It conforms to and follows the deformation of the counter-pressure surface.
- It avoids abnormal wear of the edges of the press felt.
- It is forgiving to a paper wad passing through the press nip.
- It can be manufactured at a very low cost.
- It can be designed for controlling the load within the entire press nip, or within successive sections of the press nip and independently of each other.

The support bodies that are described above and shown in the drawings have been designated press bodies, since they are used in a press apparatus. Naturally, the same embodiments of the press body can be used in other apparatus for the treatment of a fiber web in a paper or board machine, or in a calender. When the invention is applied to a wire section, the belt 6 of the first press element 1 in FIG. 1 can be replaced with a clothing, such as a wire.

The load in the nip can vary from 0 to 3000 kN/m.

The support body may have a dimension in the machine direction that typically is 50-500 mm.

The desirable elastic properties of the support body are achieved by means of a material, having a coefficient of elasticity that is substantially lower than that of metal, such as steel and aluminium, so that the support body can be elastically compressed. Typical hardness values of the elastic material is 50-95 Shore A. The elastic material should also give the support body a sufficient strength/hardness in order to withstand wear, but at the same time make the support body elastically deformable enough in order to obtain the desired function according to the invention. As elastic materials, plastic and rubber materials can be used, such as polymers, composite materials, which can be reinforced with fibers (e.g., glass fibers, carbon fibers or textile). At present, polyurethane is a preferred polymer. If desired, the contact surface of the support body can be covered by an exchangeable, thin wear protection (not shown), the one side edge portion of which is rigidly mounted to the upstream side of the holder, while the other side edge portion is free to follow the movement and deformation of the support body.

What is claimed is:

1. A method of forming an extended nip in an apparatus that comprises a support body that has two side surfaces facing from each other and connecting to a contact surface, and a bottom surface facing from the contact surface, that is arranged to be moved in the direction towards an opposed surface by means of a loading system in order to load the extended nip via the contact surface, and that is elastically deformable and has the contact surface adaptable to the opposed surface in interaction therewith, wherein the method comprises the steps of:

mounting the support body in a holding device for the support body arranged to form a counterstay for the two side surfaces of the support body and directly or indirectly form a counterstay for the bottom surface of the support body, and wherein the support body has a top portion that has the contact surface and is arranged to protrude from the holding device at least in a nip-forming operation position of the support body;

loading the support body by means of the loading system; and displacing the contact surface of the support body in the direction towards the opposed surface under the influence of the loading in order to elastically deform the contact surface and adapt the contact surface to the opposed surface.

2. The method according to claim 1, further comprising controlling the load in the extended nip by providing the support body to be formed of at least two layers of elastic material having different elasticities, and causing the contact surface to be adapted to the opposed surface in order to obtain an extended nip having a load profile in dependence of the different elasticities of the layers.

* * * * *